United States Patent [19]

Casteel

[11] 4,255,737

[45] Mar. 10, 1981

[54] TRAFFIC SIGNAL WITH TIME DURATION INDICATOR AND MECHANICAL SYNCHRONIZATION

[76] Inventor: Robert F. Casteel, 103 Sunrise La. Rte. 2, Box S 28, Mission, Tex. 78572

[21] Appl. No.: 32,667

[22] Filed: Apr. 23, 1979

[51] Int. Cl.[3] ..... G08G 1/096; G08G 1/095

[52] U.S. Cl. ..... 340/43; 116/63 R; 340/44; 340/373

[58] Field of Search ..... 340/43, 41 R, 44, 133, 340/381, 42, 373, 375; 116/63 R, 63 P; 40/554, 557, 546, 565, 541

[56] References Cited

U.S. PATENT DOCUMENTS

| | | | |
|---|---|---|---|
| 1,522,617 | 1/1925 | Degner et al. | 340/43 |
| 1,942,306 | 1/1934 | Price | 340/43 |
| 2,157,636 | 5/1939 | Shaw | 340/43 |
| 2,235,728 | 3/1941 | Ramspeck | 340/43 |
| 2,349,355 | 5/1944 | Kepler | 340/43 |
| 3,200,218 | 8/1965 | Wagner | 340/43 |

*Primary Examiner*—James J. Groody

*Attorney, Agent, or Firm*—Harvey B. Jacobson

[57] ABSTRACT

A traffic signal having a four sided housing, each side of which contains red and green areas which can be illuminated. Furthermore, each side contains a rotating semicircular mask which simultaneously, progressively covers one portion of one of the colored areas and uncovers a portion of the other colored area until the illumination of the traffic light is changed thereby causing a change in traffic flow. The rotation of the masks together with the actuation of the various lights is controlled from a common ring gear disposed within the housing and driven by a single motor.

4 Claims, 10 Drawing Figures

TRAFFIC SIGNAL WITH TIME DURATION INDICATOR AND MECHANICAL SYNCHRONIZATION

BACKGROUND OF THE INVENTION

1. Field of the Invention

This invention relates to traffic light signals for controlling the flow of traffic on roads and highways.

2. Discussion of Relevant Art

Numerous traffic signal devices have been proposed in the past. One type of such device includes a housing having four walls with lights disposed in each of the walls. A centrally located rotating element sequentially illuminates the appropriate light for controlling traffic flow. Examples of this type of mechanism are shown in U.S. Pat. No. 1,466,809, issued Sept. 4, 1923, to Strong, U.S. Pat. No. 1,757,050, issued May 6, 1930, to Johnson, and U.S. Pat. No. 1,758,481, issued May 13, 1950, to Torrence. Additionally, some of the proposed traffic signals include light change indicators. For instance, U.S. Pat. No. 2,020,610, issued Nov. 12, 1935, to Johns includes gas tube signalling element having extensions which are illuminated in fractional parts, additively or subtractively, to visibly indicate the time remaining between differing illumination patterns of the traffic signal. U.S. Pat. No. 2,021,954, issued Nov. 26, 1935, to Campion, shows a traffic signal wherein rotating shutters having arcuately shaped slots are disposed over opposed warning tubes to progressively cover and uncover the warning tubes thereby indicating the time left before the light changes.

However, none of the above mentioned patents provides a scheme to insure positive mechanical synchronization between light changing circuitry and light change indicators on traffic lights having portions facing in all directions at an intersection. Such positive synchronization is necessary to insure smooth traffic flow and should be effected through mechanical interconnections for maintaining synchronization over a long period of time.

SUMMARY OF THE INVENTION

One object of the present invention is to provide a traffic signal which is relatively inexpensive to manufacture, simple in construction, yet rugged and effective in operation.

A further object of the present invention is to provide a traffic signal which includes a lapsed time indicator for communicating the time remaining before a change in direction of traffic flow.

A still further object of the present invention is to provide a traffic signal which includes an all stop portion and left turn only signals as well as the standard two direction go and stop signals.

Another object of the present invention is to provide a traffic signal in which all the signalling functions are controlled through the use of a single rotating ring gear located in the center of the device.

These together with other objects and advantages which will become subsequently apparent reside in the details of construction and operation as more fully hereinafter described and claimed, reference being had to the accompanying drawings forming a part hereof, wherein like numerals refer to like parts throughout.

FIGS. *6a–6d* are a series of schematic views showing the progressive exposure and covering of the warning bars.

Figure 7:
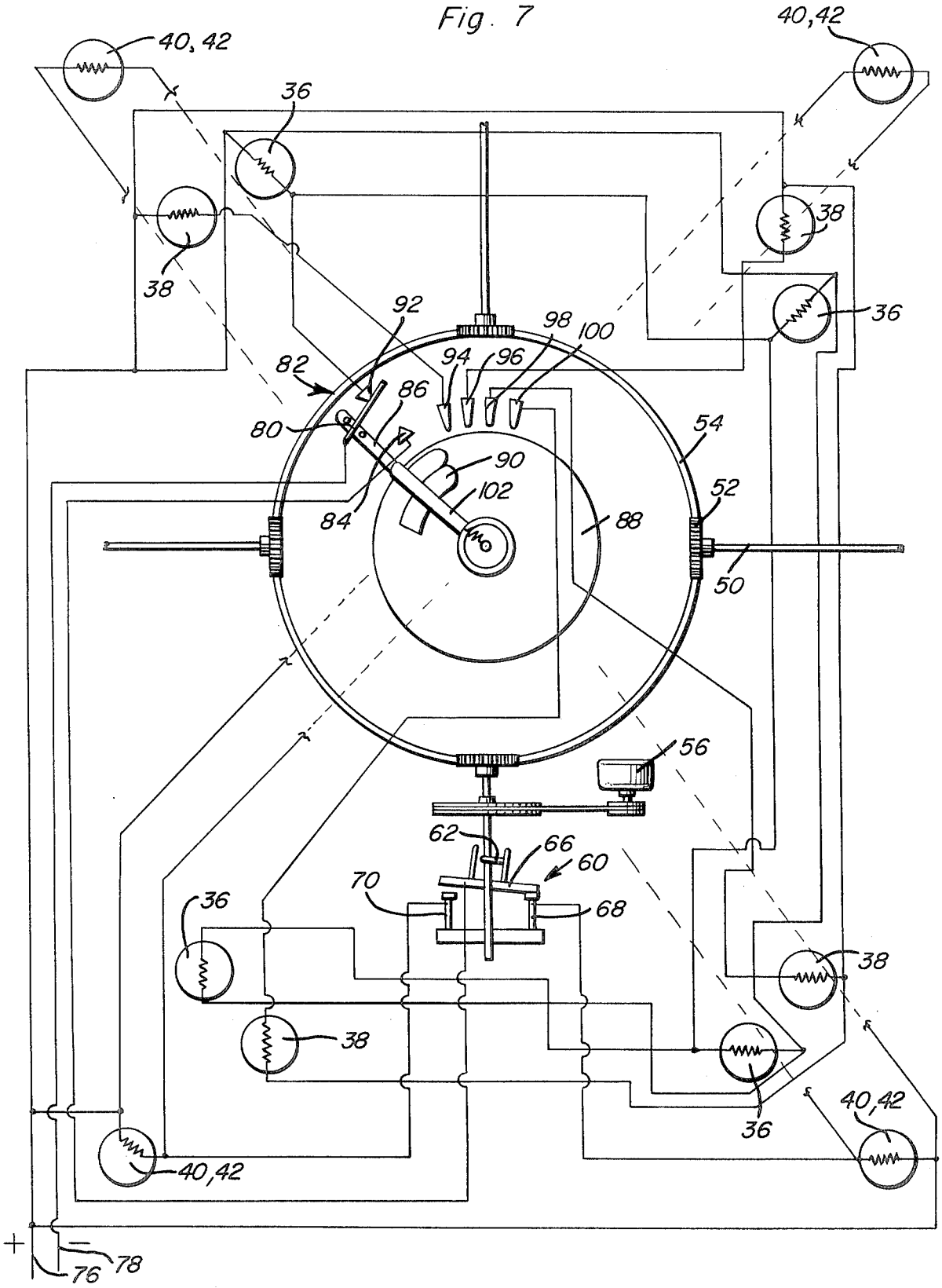

FIG. 7 is a schematic diagram of the wiring of the present invention.

DESCRIPTION OF THE PREFERRED EMBODIMENT

Now, with reference to the drawings, the traffic signal generally referred to by the numeral 10 will be set forth in detail. Especially with reference to FIGS. 1 through 4, it can be seen that the traffic signalling includes a housing 12 which is generally square in plan and rectangular in elevation and has four identical sides 14. The traffic signal is hung over the center of an intersection in a depending manner on support 16 and is attached to four blinders 18 which extend diagonally away from the corners of the housing to insure that any one side 14 is visible only from one lane of oncoming traffic.

Each side 14 includes an outer wall 19 which has an upper translucent area 20 having the word "STOP" imprinted thereon. The four "STOP" areas of the traffic signal are illuminated simultaneously to allow pedestrians to cross the intersection. The upper left corner of outer wall 19 has a second translucent area generally marked by the reference numeral 22 and having the words "LEFT TURN ONLY" imprinted thereon. Areas 22 are illuminated sequentially to allow traffic to make a left hand turn after the pedestrian crossing sequence is terminated. The lower portion of outer wall 19 covers an inner wall 23 which has a green colored section generally labeled 24 which extends vertically on the right side of wall 14 and is covered by translucent portion 25 of outer wall 23. Green section 24 extends laterally across the side wall to form green warning bar 26. In like manner, a red area 28 is included on the left side of inner wall 23 and is covered by a translucent section 30 of outer wall 19. That area 28 extends laterally across the face of inner wall 23 to form red warning bar 32. An opening 34 is formed in the outer wall to expose the area of inner wall 23 containing warning bars 26 and 32.

Disposed behind areas 20 and 22 are bulbs 36 and 38, respectively, while disposed in each corner of the housing behind inner wall 23 is a pair of vertically spaced bulbs 40 and 42. Each pair of bulbs 40, 42 can illuminate a first channel 44 which extends laterally behind the upper portion of one inner wall 23 behind the red warning bar 32 of that wall and behind the lower portion of an adjacent inner wall behind the green warning bar 26 of that adjacent wall in a channel generally marked 46.

Accordingly, it can be seen that when one pair of lights 40, 42 is illuminated the red area of one side of the traffic signal becomes illuminated together with the red warning bar of that side, and the green area of an adjacent side likewise becomes illuminated together with its green warning bar. These red and green areas are clearly visible through the translucent outer walls of the traffic signal while the warning bars are clearly visible through the opening 34 in the outer wall.

In order to provide an indication of the time remaining before the signal turns, a mask 48, which is also shown clearly in FIGS. 1 through 4, is disposed between outer wall 19 and inner wall 23 of each side 14. Each mask 48 has a generally semi-circular shape and thereby covers approximately half of the opening 34. Each mask 48 is mounted on a shaft 50 and is rotated in its respective opening 34 to progressively cover or uncover the warning bars 26, 32. The operation of mask 48 can be clearly understood with reference to FIGS. *6a–6d* wherein the mask can be seen progressing from a first position wherein red warning bar 32 is completely exposed in FIG. *6a*. At this time the red area 28 would be illuminated and the oncoming traffic facing that side of the traffic signal would be halted. The mask 48 rotates in a clockwise direction progressively covering larger segments of warning bar 32 and uncovering portions of warning bar 26. In this manner, the vehicle operators are provided with an indication of the time duration remaining until the signal light will switch from red to green. The mask 48 continues to rotate in a clockwise direction until a point where virtually all of the green warning bar 26 is exposed, shown in FIG. *6d*. At this time, the lights behind red area 28 are extinguished and the lights behind green area 24 are illuminated. The mask 48 continues to rotate providing a similar indication of the time remaining until the red light is once again illuminated.

Figure 1:
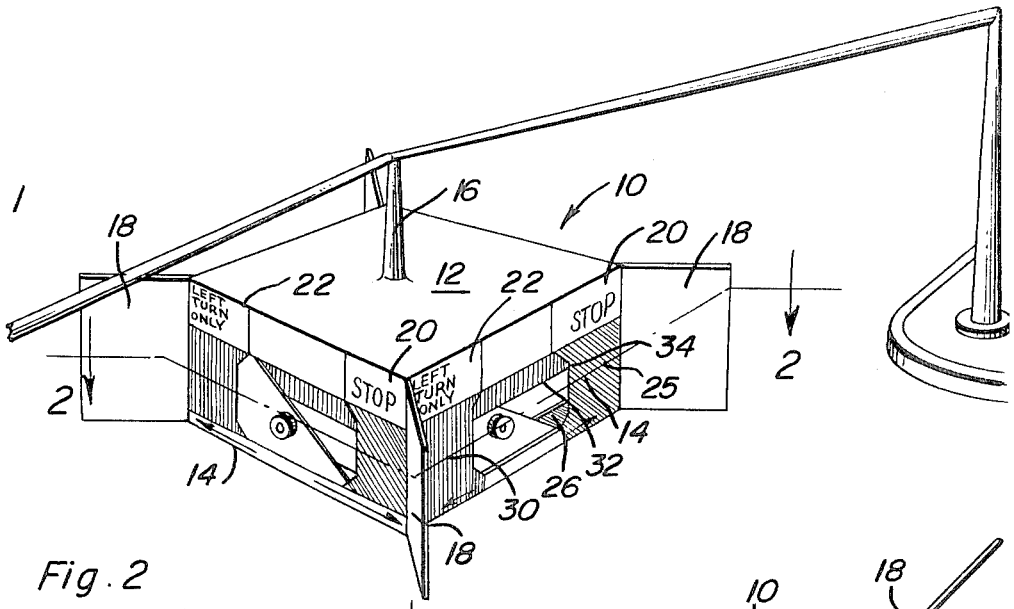
FIG. 1 is a perspective view of the traffic signal shown hung in the center of an intersection.
Figure 2:
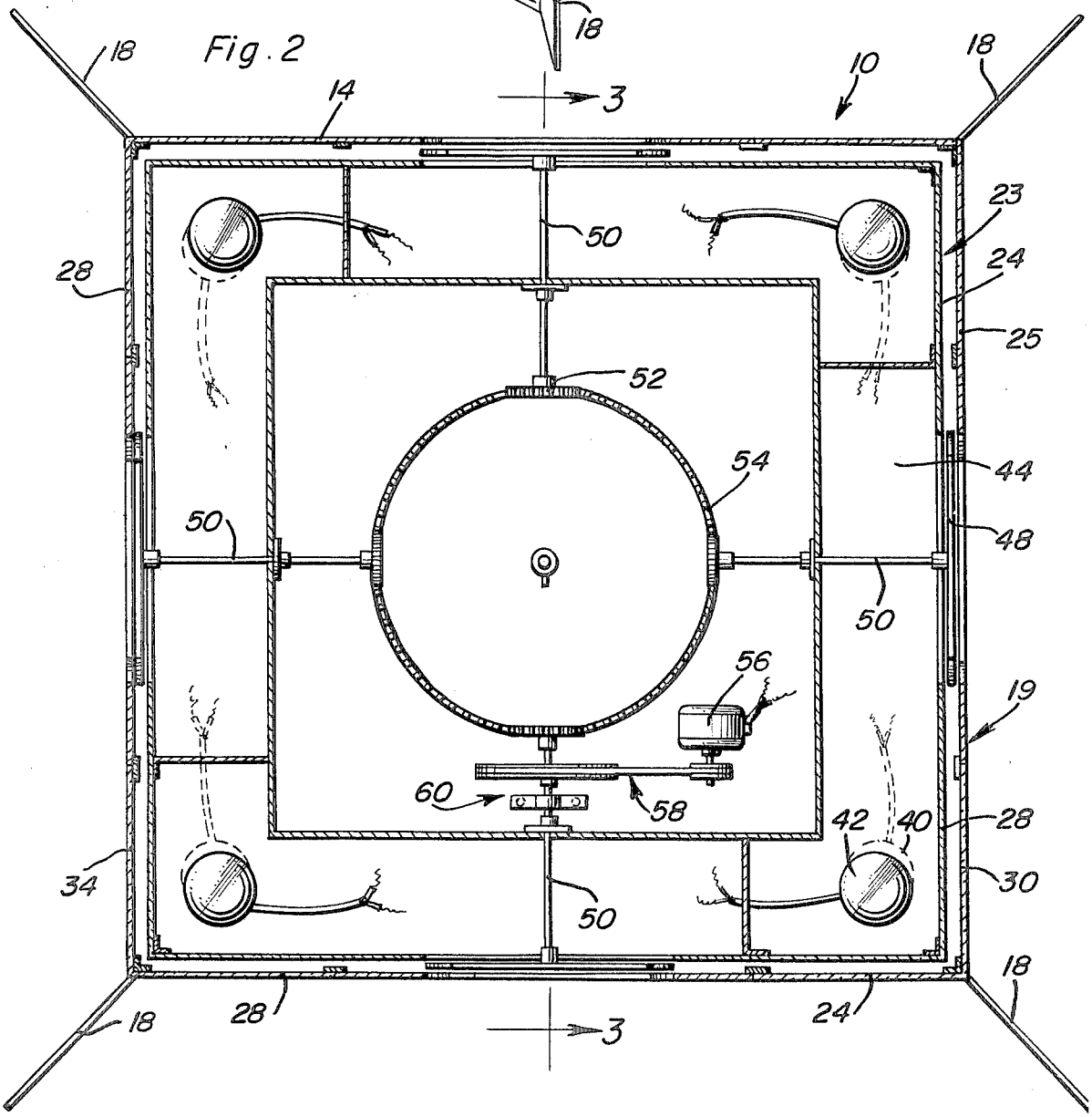
FIG. 2 is a top plan sectional view taken substantially along the plane passing through section line 2—2 of FIG. 1.
Figure 3:
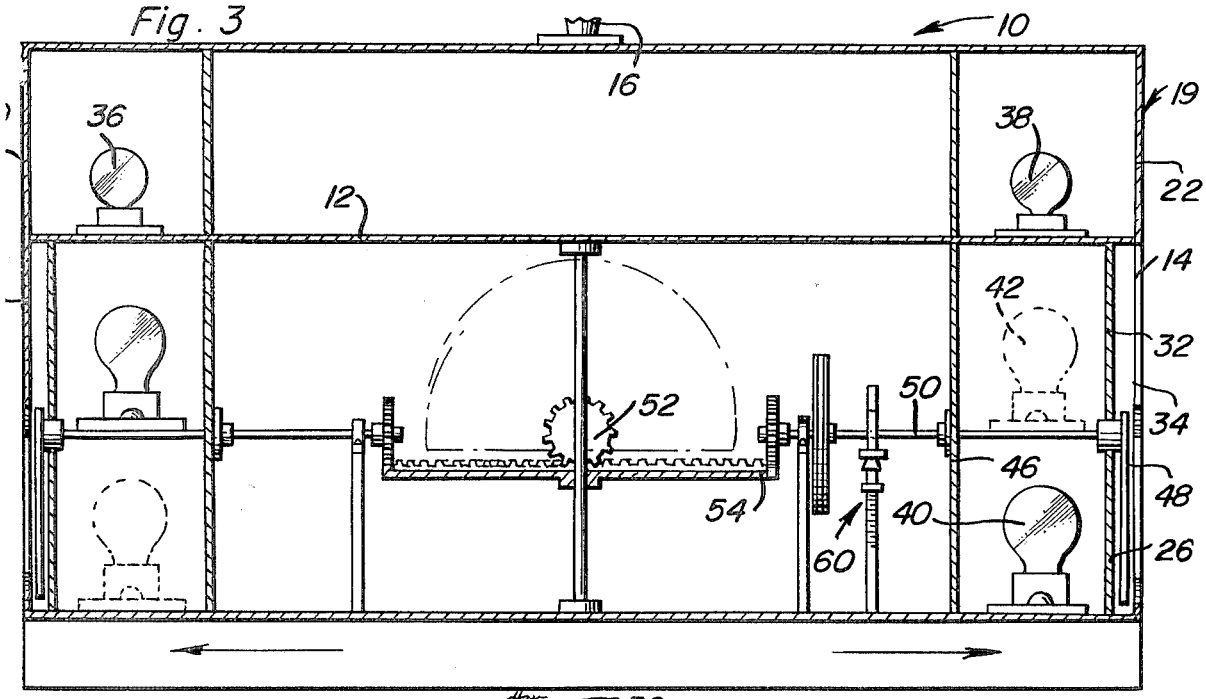
FIG. 3 is a side elevational sectional view taken substantially along the plane passing through section line 3—3 of FIG. 2.
Figure 4:
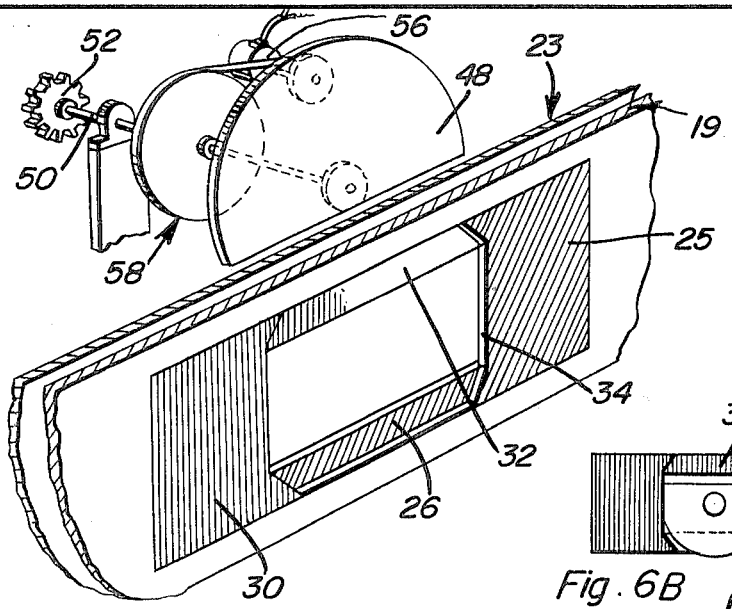
FIG. 4 is an exploded view of one mask and the light display panel of the present invention.
Figure 6A:
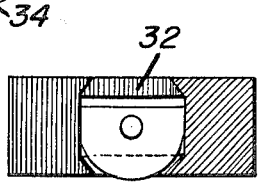
Figure 6B:
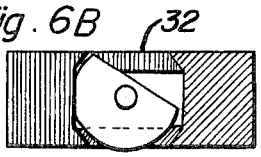
Figure 6C:
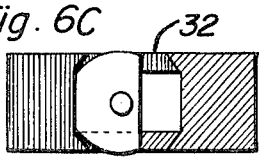
Figure 6D:
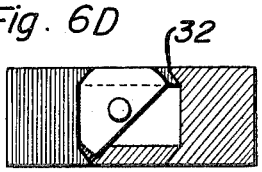
Figure 5:
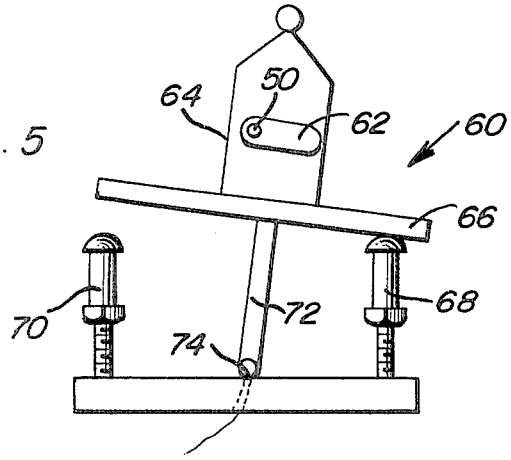
FIG. 5 is an enlarged view of the rocker switch mechanism of the present invention.

In order to provide accurate timing for the traffic signal, all shafts 50 connected to their respective masks 48 are attached to gears 52 which ride on a common ring gear 54 disposed centrally of the housing 12. Power is supplied to rotate the ring gear and the masks through a single electric motor 56 which drives one of the shafts 50 through a pulley and belt drive arrangement 58. In order to control the timing of the switching of the traffic signal from red to green, a cam operated rocker switch generally referred to by the numeral 60 is mounted in housing 12 and operated by one of the shafts 50. The rocker switch 60 is shown in FIG. 5 to include a cam element 62 mounted on shaft 50 and disposed within cam follower 64. Cam follower 64 is attached to a pivotally mounted contactor bar 66 which makes contact with one of two stationary contacts 68 and 70 as the contactor 66 pivots on support 72 about support mounting point 74.

Now with reference to FIG. 7, it can be seen that diagonally opposed light pairs 40, 42 are connected in parallel circuits with one terminal of each light being connected to positive input line 76 while the opposite terminal of one diagonally opposed light grouping is connected to stationary contact 68 of rocker switch 60 and the other diagonally opposed light grouping is connected through stationary contact 70 of switch 60. Negative input line 78 is connected to movable contact 80 of switch 82. Stationary contact 84 is connected to contactor 66 of switch 60. Accordingly, when movable contact 80 of switch 82 is abutting stationary contact 84, a circuit is completed through rocker switch 60 with position of cam 62, and therethrough the position of contactor 66, determining which of the diagonally opposed light groupings will be illuminated. Since cam 62 is operated through ring gear 54, synchronism will exist between the actuation of the lights 40, 42 and the position of masks 48 thereby producing the signalling operation discussed hereinabove.

Switch 82 is operated by a push rod 86 which is spring biased radially inward of gear 54 toward plate 88 which rotates with the ring gear 54. Mounted on plate 88 is a cam 90 which hits push rod 88 and urges it outwardly causing the movable contact 80 to abut stationary contact 92 for a time duration determined by the length of cam 90. When contact 80 abuts stationary contact 92, one side of each light 36 is connected to negative leads 78. The opposite side of each light 36 is connected to positive lead 76. As will be recalled from previous discussion, lights 36 cause illumination of the "STOP" signal portion 20 of the traffic signal. Accordingly, it can be seen that while "STOP" portion 20 is illuminated, no current is directed to red and green lower portion of the traffic signal. Lights 38, which it will be recalled are positioned behind the "LEFT TURN ONLY" portion 22 of the signal light, are also connected in parallel with one terminal of each light being attached to positive line 76. The opposite terminals of the individual lights are connected, respectively, to stationary contacts 94, 96, 98 and 100. As plate 88 turns, finger 102 sequentially contacts each of the stationary contacts 94, 96, 98 and 100. Finger 102 is connected through a slip ring or other suitable connector means to negative terminal 78. Accordingly, sequential operation of lights 38 is effected thereby permitting the four individual lanes of traffic to make left hand turns. It should be noted that cam 90 is of sufficient length to insure that "STOP" lights 36 are illuminated during the left hand turn signals and also that no current will be supplied to the red and green sections of the traffic signal during a left hand turn segment of operation. Naturally, when cam 90 is rotated pass push rod 86 by plate 88, the biasing on push rod 86 causes it to move radially inward bringing movable contact 80 with it thereby reconnecting the red and green portions of the traffic signal with the power input lines and returning the signal to its original state.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A traffic signal comprising: a housing having a plurality of side walls, with each side wall including a first colored portion operatively related to a first lamp for transmitting the color of said first portion; and a second colored portion operatively related to a second lamp for transmitting the color of said second portion; a plurality of substantially semi-circular masks wherein each of said masks lies in a plane parallel to its respective said wall and rotating in that plane for sequentially covering and uncovering sections of said first and second portions;

timing means including a single ring gear disposed within said housing and rotating therein for providing a synchronized mechanical linkage between said masks, wherein each of said masks includes a shaft fixedly attached thereto for causing rotation of said masks with each shaft including a driving gear fixedly attached to the shaft and operatively engaged with said ring gear, one of said shafts including drive means operatively engaged with a motor for causing rotation of said shaft and said ring gear; further wherein said first colored portion of each side wall includes an extension which is disposed laterally of said side wall and said second colored portion includes an extension which is disposed laterally of said side wall and vertically spaced from the extension of said first colored portion, said extensions comprising the sections which are covered and uncovered by said mask; a "LEFT TURN ONLY" signal means included in each of said side walls; a "STOP" signal means included in each of said side walls, switch means for selectively energizing either said first and second lamps or said "STOP" signal means, said switch means comprising a cam carried by said ring gear, a two position switch mounted stationarily with respect to said ring gear, and a switch actuator means for moving said switch between said two positions upon contact by said cam.

2. The structure of claim 1 wherein said "LEFT TURN ONLY" signal means are sequentially operated by a movable contact which rotates with said ring gear and sequentially contacts a plurality of stationary contacts which are respectively connected to said "LEFT TURN ONLY" signal means, and further wherein said cam is mounted to said movable contact.

3. The structure of claim 2 and further including a plurality of blinders which extend away from the intersection of said side walls.

4. The invention as defined in claim 2 wherein said contact extends radially of said ring gear and mounts said cam.

* * * * *